US008381559B2

(12) United States Patent
Rey-Mas

(10) Patent No.: US 8,381,559 B2
(45) Date of Patent: Feb. 26, 2013

(54) METHOD FOR OPERATING A MILL TRAIN, IN PARTICULAR IN A COLD ROLLING MILL

(75) Inventor: Luis Rey-Mas, Berlin (DE)

(73) Assignee: Converteam GmbH, Berlin (DE)

( * ) Notice: Subject to any disclaimer, the term of this patent is extended or adjusted under 35 U.S.C. 154(b) by 471 days.

(21) Appl. No.: 12/654,525

(22) Filed: Dec. 22, 2009

(65) Prior Publication Data

US 2010/0229612 A1 Sep. 16, 2010

(30) Foreign Application Priority Data

Mar. 10, 2009 (DE) ..... 10 2009 012 028

(51) Int. Cl.
*B21B 39/00* (2006.01)

(52) U.S. Cl. ..... 72/7.6

(58) Field of Classification Search ..... 72/7.6, 72/9.2–9.4, 10.3, 11.8
See application file for complete search history.

(56) References Cited

U.S. PATENT DOCUMENTS

| | | | | |
|---|---|---|---|---|
| 3,636,743 | A | 1/1972 | Murtland, Jr. | |
| 2010/0064749 | A1 * | 3/2010 | Kaga et al. | 72/11.4 |
| 2010/0326154 | A1 * | 12/2010 | Felkl | 72/7.6 |

FOREIGN PATENT DOCUMENTS

| | | |
|---|---|---|
| DE | 21 29 629 | 12/1971 |
| DE | 41 41 742 | 6/1993 |
| DE | 102 54 178 | 6/2004 |
| JP | 60-96320 | 5/1985 |

OTHER PUBLICATIONS

European Search Report dated Jul. 20, 2010.

* cited by examiner

*Primary Examiner* — Faye Francis
(74) *Attorney, Agent, or Firm* — Harness, Dickey & Pierce, P.L.C.

(57) ABSTRACT

One embodiment of the present invention discloses a method for operating a mill train, in particular used in a cold-rolling mill. The mill train includes operating rolls with a roll gap disposed in-between through which a rolled strip is guided. With the method of at least one embodiment, the thickness and the roll-in speed of the rolled strip are measured in front of the roll gap. The roll-out speed of the rolled strip after the roll gap is reconstructed with the aid of the tangential speed of the operating rolls. The thickness after the roll gap is then determined with the aid of the thickness and the roll-in speed in front of the roll gap and the reconstructed roll-out speed.

18 Claims, 1 Drawing Sheet

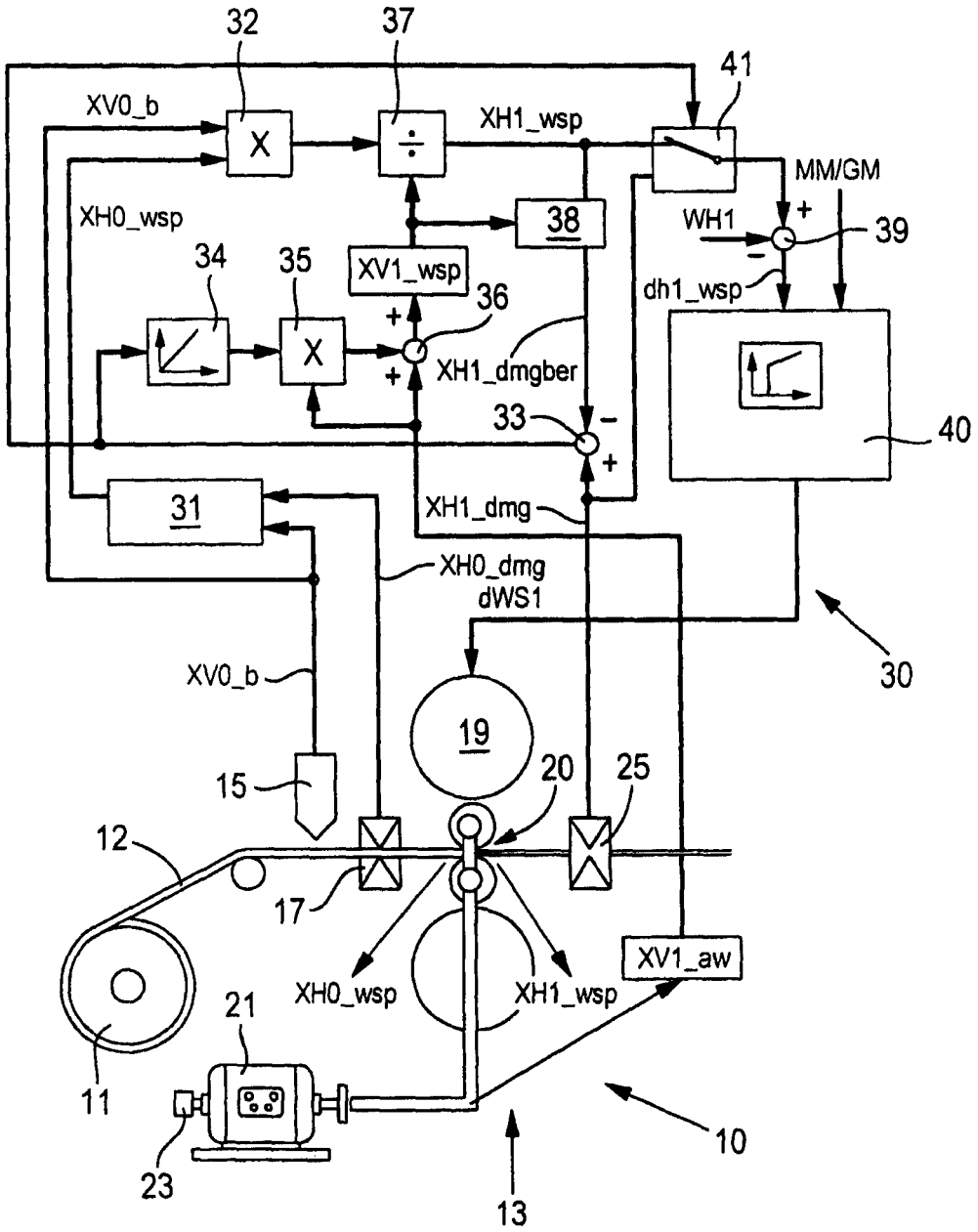
32
37
41
XV0_b
X
÷
XH1_wsp
MM/GM
XH0_wsp
38
WH1
39
34
35
XV1_wsp
36
dh1_wsp
X
XH1_dmgber
33
40
31
XH1_dmg
XH0_dmg
dWS1
30
XV0_b
19
15
20
25
12
17
XV1_aw
XH0_wsp
XH1_wsp
21
11
10
23
13

METHOD FOR OPERATING A MILL TRAIN, IN PARTICULAR IN A COLD ROLLING MILL

PRIORITY STATEMENT

The present application hereby claims priority under 35 U.S.C. §119 on German patent application number DE 10 2009 012 028.9 filed Mar. 10, 2009, the entire contents of which are hereby incorporated herein by reference.

FIELD

At least one embodiment of the invention generally relates to a method for operating a mill train, in particular in a cold rolling mill.

BACKGROUND

A method for controlling the thickness of a rolled strip on a mill train used in a rolling mill is known from the document DE 41 41 742 A1. This method is based on mass-flow control which is used to compute the output thickness of the rolled strip from the measured input thickness of the rolled strip as well the measured input and output speeds at the roll gap.

In particular the measurement of the rolled strip speed at the output of the roll gap has proven to be problematic since vibrations or a dirty measuring location or other measuring errors can interfere with the thickness control.

SUMMARY

In at least one embodiment of the present invention, a method is created which has a higher accuracy and reliability.

The mill train of at least one embodiment comprises operating rolls with a roll gap disposed in-between through which a rolled strip is guided. The thickness and the roll-in speed of the rolled strip are measured in front of the roll gap. The roll-out speed of the rolled strip after the roll gap is reconstructed with the aid of the tangential speed of the operating rolls. The thickness after the roll gap is determined with the aid of the thickness and the roll-in speed measured in front of the roll gap, as well as the reconstructed roll-out speed.

By reconstructing the roll-out speed of the rolled strip after the roll gap, it is no longer necessary to measure this roll-out speed, so that a measuring instrument required for this measurement can be omitted. Not only does this represent a reduction in costs, but also an increase in the reliability and accuracy of the mill train operation.

According to one embodiment of the invention, the thickness determined after the roll gap is compared to a measured thickness after the roll gap, wherein the determined thickness is advantageously corrected with the aid of a transit time element. By taking this measure, a variable is made available, meaning the resulting difference, which can effect the aforementioned reconstruction in such a way that this variable, if possible, becomes zero. As a result, the accuracy of the reconstructed roll-out speed for the rolled strip after the roll gap is increased.

For different embodiments of the invention, the difference between the determined thickness and the measured thickness after the roll gap is integrated and is then multiplied, if applicable, with the tangential speed of the operating rolls. As simple but nevertheless extremely accurate reconstruction of the roll-out speed after the roll gap is thus obtained.

For yet another embodiment, the result of the multiplication is added to the tangential speed of the operating rolls and the result of this addition then forms the roll-out speed of the rolled strip after the roll gap.

BRIEF DESCRIPTION OF THE DRAWINGS

Additional features, options for use, and advantages of the invention can be deduced from the following description of example embodiments of the invention which are shown in the drawing. All features described or illustrated herein, either by themselves or in any optional combination, therefore represent the subject matter of the invention, regardless of how they are summarized in the patent claims and the references back of said claims and regardless of their formulation or representation in the description or the drawing.

The single FIGURE in the drawing shows a schematic block diagram of an example embodiment of a mill train for a method according to the invention for operating a mill train.

DETAILED DESCRIPTION OF THE EXAMPLE EMBODIMENTS

A mill train 10, in particular used in a cold rolling mill, comprises an unreeling device 11 from which a rolled strip 12 is guided over deflection rollers to a roll stand 13. Arranged in front of the roll stand 13 is a measuring device 15, in particular a laser meter. The measuring device 15 is provided for measuring the roll-in speed XV0_b of the rolled strip 12 in front of the roll stand 13. A thickness measuring device 17 is furthermore arranged in front of the roll stand 13 for measuring a thickness XH0_dmg of the rolled strip 12 in front of the roll stand 13.

The roll stand 13 of the mill train 10 comprises operating rolls 19 with a roll gap 20 disposed in-between through which the rolled strip 12 is guided. The operating rolls 19 are driven by a motor 21 and a gear assembly. A measuring device 23 is assigned to the drive motor 21 for measuring a rotational speed of the drive motor 21. By using the diameter of the operating rolls 19 as well as the gear ration for the gear assembly, the tangential speed XV1_aw of the operating rolls 19 is thus made available.

A measuring device 25 is arranged along the mill train 10, after the roll stand 13, which measuring device is used to measure a thickness XH1_dmg of the rolled strip 12 after the roll stand 13.

The thickness of the rolled strip 12 directly in front of the roll gap 20 is characterized in the FIGURE as thickness XH0_wsp and the thickness of the rolled strip 12 directly behind the roll gap 20 is characterized as thickness XH0_wsp. Both variables are not measured, but are computed as explained in the following.

The roll gap 20 of the present embodiment can be adjusted for influencing the thickness of the rolled strip 12 by adjusting the position of the operating rolls 19 in the mill train 10 relative to each other. An adjustment variable dWS1 in the FIGURE is used to characterize the position of the operating rolls 19 relative to each other and thus also the adjustment of the roll gap 19.

The mill train 10 is assigned an automatic control 30 to which the mill train 10 supplies the roll-in speed XV0_b as well as the thicknesses XH0_dmg and XH1_dmg in front of and behind the roll stand 13. This automatic control subsequently generates the adjustment variable dWS1 and supplies this variable to the mill train 10.

The automatic control 30 then realizes a path imaging 31, with the aid of which the thickness XH0_wsp immediately in front of the roll gap 20 is determined from the previously mentioned thickness XH0_dmg measured in front of the roll stand 13. For the present embodiment, this is achieved by forming a transit time element with the aid of the roll-in speed XV0_b, which takes into account the time duration required by the rolled strip 12 for traveling the distance from the measuring device 15 to the roll gap 20.

The automatic control 30 carries out a multiplication 32 by multiplying the roll-in speed XV0_b of the rolled strip with the thickness XH0_wsp immediately before the roll gap 20. The resulting product represents the left side of the basic equation for a mass-flow control. This basic equation reads as follows for the present example embodiment:

$$XH0_wsp*XV0_b=XH1_wsp*XV1_b.$$

The right side of this basic equation is obtained by forming the product of the previously mentioned thickness XH1_wsp, present immediately after the roll gap 20, and an roll-out speed XV1_b of the rolled strip 12. The roll-out speed XV1_b is not measured but is reconstructed and/or modeled with a computation, as explained in the following.

For this, the automatic control 30 realizes a comparison 33 between the thickness XH1_dmg after the roll stand 13 and a computed thickness XH1-dmgber. The difference between the two thicknesses is then fed to an integration circuit 34, and the integrated difference then represents a factor of a multiplication 35. Added to this multiplication 35 is the tangential speed XV1_aw of the operating rolls 19 as additional factor.

The product obtained with the aid of the multiplication 35 is then added by addition 36 to the aforementioned tangential speed XV1_aw of the operating rolls 19, thus providing an roll-out speed XV1_wsp that is present immediately after the roll gap 20. This roll-out speed XV1_wsp, which is determined by computation, is used for the reconstruction and/or modeling of the aforementioned roll-out speed XV1_b of the rolled strip.

The automatic control 30 then carries out a division 37, for which the product of the multiplication 32 on the left side of the previously explained basic equation is divided by the roll-out speed. According to the above basic equation and the above-explained reconstruction, the result of the division 37 thus provides the thickness XH1_wsp present immediately following the roll gap 20 of the rolled strip 12 as follows:

$$XH1_wsp=XH0_wsp*XV0_b/XV1_wsp.$$

The automatic control 30 realizes a path imaging 38, which is then used to determine the aforementioned thickness XH1_dmgber, existing immediately after the roll gap 20, from the thickness XH1_wsp. This is realized for the present example embodiment by forming a transit time element with the aid of the reconstructed roll-out speed XV1_wsp, which takes into account the time needed for the rolled strip 12 to travel from the roll gap 20 to the measuring device 25.

For the normal operation of the mill train 10, the thickness XH1_wsp immediately after the roll gap 20 is used as actual thickness of the rolled strip 12, which is supplied to a comparison 39 with an actual thickness WH1 of the rolled strip 12. The difference dh1_wsp between these thicknesses is then supplied to a PI (proportional/integral) controller 40 which can furthermore also be influenced by a material module MM and/or a frame module GM. The PI controller 40 generates the adjustment variable dWS1 for adjusting the roll gap 20, as previously mentioned. The adjustment variable dWS1 can be formed, for example, using the following equation:

$$dWS1=dh1_wsp+(dh1_wasp*MM/GM).$$

For the startup of the mill train 10, for example, the automatic control 30 is provided with a changeover 41, for which the computed thickness XH1_wsp that is present immediately after the roll gap 20 is no longer used as the actual thickness. Instead, the thickness XH1_dmg measured by the measuring device 25 is used, wherein this thickness XH1_dmg is then compared to the desired thickness WH1 and the difference supplied to the PI controller 40. The PI controller 40 subsequently generates the adjustment variable dWS1 for influencing the roll gap 20. The variables used to influence the proportional and/or the integral share of the PI controller 40 in this case can be selected different from the normal operation. A so-called monitor control is preferably used for this.

The changeover 41 is influenced by the difference formed with the aid of the thicknesses XH1_dmg and XH1_dmgber. If this difference is below a predetermined threshold value, the mill train 10 is operating normally and the changeover 41 forwards the computed thickness XH1_wsp, existing immediately after the roll gap 20, as the actual thickness. However, if the aforementioned thickness is above the threshold value, the operation is not normal and the measured thickness XH1_dmg is transmitted as the actual thickness. For example, the threshold value can have the value +/−3% of the desired thickness WH1.

During normal operations of the mill train 10, the roll-out speed XV1_wsp of rolled strip 12, which is present immediately after the roll gap 20, is reconstructed from the tangential speed XV1_aw of the operating rolls 19. Among other things, this is achieved by correcting the thickness XH1_wsp of the rolled strip 12, existing directly after the roll gap 20 and computed from the reconstructed roll-out speed XV1_wsp, with the aid of the path imaging 38 and then comparing it to the measured thickness XH1_dmg of the rolled strip 12. In the process, the integrator 34 and the multiplier 35 act upon the reconstructed roll-out speed XV1_wsp in such a way that the difference resulting from the aforementioned comparison is zero, if possible.

The described automatic control 30 is realized with the aid of an electronic circuit, wherein this can be an analog circuit or a digital computer. If a digital computer is used, then the explained automatic control 30 takes the form of a computer program which is stored in a computer memory and is suitable for realizing the explained sequences of the automatic control 30.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A method for operating a mill train, wherein the mill train includes operating rolls, with a roll gap disposed in-between, through which a rolled strip is guided, the method comprising:

measuring a thickness and a roll-in speed of the rolled strip in front of the roll gap;

reconstructing a roll-out speed of the rolled strip, after the roll gap, with the aid of a tangential speed of the operating rolls; and determining the thickness after the roll gap with the aid of the measured thickness and the roll-in speed in front of the roll gap and the reconstructed roll-out speed.

2. The method according to claim 1, wherein the tangential speed of the operating rolls is determined in dependence on the rotational speed of a drive motor that drives the operating rolls.

3. The method according to claim 2, wherein the determined thickness after the roll gap is corrected and is then compared to a measured thickness after the roll gap.

4. The method according to claim 1, wherein the determined thickness after the roll gap is corrected and is then compared to a measured thickness after the roll gap.

5. The method according to claim 4, wherein the determined thickness is corrected with the aid of a transit time element.

6. The method according to claim 5, wherein the difference between the corrected, determined thickness and the measured thickness after the roll gap is integrated.

7. The method according to claim 4, wherein the difference between the corrected, determined thickness and the measured thickness after the roll gap is integrated.

8. The method according to claim 7, wherein the integrated difference is multiplied with the tangential speed of the operating rolls.

9. The method according to claim 8, wherein a result of the multiplication is added to the tangential speed of the operating rolls and a result of the addition forms the roll-out speed of the rolled strip after the roll gap.

10. The method according to claim 1, wherein the determined thickness of the rolled strip after the roll gap is compared to a desired value.

11. The method according to claim 10, wherein, insofar as the mill train does not operate normally, the measured thickness of the rolled strip after the roll gap is compared to a desired value in place of the determined thickness.

12. The method according to claim 11, wherein a result of the comparison is supplied to a controller, which influences the position of the operating rolls.

13. The method according to claim 10, wherein a result of the comparison is supplied to a controller, which influences the position of the operating rolls.

14. The method according to claim 1, wherein the method is for operating a mill train used in a cold rolling mill.

15. A computer program product comprising a non-transitory computer readable medium having computer readable program codes embodied in the medium that, when executed, cause a computer to implement a method for operating a mill train, wherein the mill train includes operating rolls, with a roll gap disposed in-between, through which a rolled strip is guided, the method comprising:

measuring a thickness and a roll-in speed of the rolled strip in front of the roll gap;

reconstructing a roll-out speed of the rolled strip, after the roll gap, with the aid of a tangential speed of the operating rolls; and determining the thickness after the roll gap with the aid of the measured thickness and the roll-in speed in front of the roll gap and the reconstructed roll-out speed.

16. A digital computer provided with a memory including a computer program having instructions for implementing a method for operating a mill train, wherein the mill train includes operating rolls, with a roll gap disposed in-between, through which a rolled strip is guided, the method comprising:

measuring a thickness and a roll-in speed of the rolled strip in front of the roll gap;

reconstructing a roll-out speed of the rolled strip, after the roll gap, with the aid of a tangential speed of the operating rolls; and determining the thickness after the roll gap with the aid of the measured thickness and the roll-in speed in front of the roll gap and the reconstructed roll-out speed, when executed on the computer.

17. A mill train, comprising:

an electronic circuit configured to realize a method for operating a mill train, wherein the mill train includes operating rolls, with a roll gap disposed in-between, through which a rolled strip is guided, the method including measuring a thickness and a roll-in speed of the rolled strip in front of the roll gap;

reconstructing a roll-out speed of the rolled strip, after the roll gap, with the aid of a tangential speed of the operating rolls; and determining the thickness after the roll gap with the aid of the measured thickness and the roll-in speed in front of the roll gap and the reconstructed roll-out speed.

18. The mill train as defined in claim 17, further comprising:

a digital computer provided with a memory including a computer program having instructions for implementing a method for operating a mill train, wherein the mill train includes operating rolls, with a roll gap disposed in-between, through which a rolled strip is guided, the method including measuring a thickness and a roll-in speed of the rolled strip in front of the roll gap;

reconstructing a roll-out speed of the rolled strip, after the roll gap, with the aid of a tangential speed of the operating rolls; and determining the thickness after the roll gap with the aid of the measured thickness and the roll-in speed in front of the roll gap and the reconstructed roll-out speed, when executed on the computer.

* * * * *